US007287749B2

(12) United States Patent
Frank et al.

(10) Patent No.: US 7,287,749 B2
(45) Date of Patent: Oct. 30, 2007

(54) TRANSPORT SYSTEM IN A MACHINE THAT PROCESSES PRINTING MATERIAL

(75) Inventors: Hendrik Frank, Heidelberg (DE); Frank Ballandt, Ralbitz-Rosenthal (DE); Dietmar Berger, Dresden-Altfranken (DE); Thomas Schaeffer, Mauer (DE); Ivonne Schleweis, Mühlhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 303 days.

(21) Appl. No.: 10/982,577

(22) Filed: Nov. 5, 2004

(65) Prior Publication Data

US 2005/0093224 A1 May 5, 2005

Related U.S. Application Data

(60) Provisional application No. 60/523,328, filed on Nov. 19, 2003.

(30) Foreign Application Priority Data

Nov. 5, 2003 (DE) ..... 103 51 619

(51) Int. Cl.
*B65H 5/10* (2006.01)

(52) U.S. Cl. ..... 271/225; 271/268

(58) Field of Classification Search ..... 271/3.24, 271/85, 151, 202–206, 216, 222, 270, 901, 271/225; 198/367, 367.1, 457.05; 310/12; 104/292

See application file for complete search history.

(56) References Cited

U.S. PATENT DOCUMENTS

| | | | | |
|---|---|---|---|---|
| 4,792,036 A | | 12/1988 | Heidelberg | |
| 5,809,892 A | * | 9/1998 | Kruger et al. | 101/483 |
| 5,947,361 A | * | 9/1999 | Berger et al. | 226/92 |
| 6,044,760 A | | 4/2000 | Krüger | |
| 6,092,801 A | | 7/2000 | Abbadessa et al. | |
| 6,240,843 B1 | | 6/2001 | Krüger et al. | |
| 6,398,009 B1 | * | 6/2002 | Emery | 198/436 |
| 6,533,106 B1 | * | 3/2003 | Lykkegaard | 198/800 |
| 6,578,495 B1 | * | 6/2003 | Yitts et al. | 104/292 |
| 6,923,116 B2 | * | 8/2005 | Wicha | 101/91 |

FOREIGN PATENT DOCUMENTS

| | | |
|---|---|---|
| DE | 33 38 199 A1 | 5/1985 |
| DE | 690 03 785 T2 | 5/1991 |
| DE | 43 11 863 C1 | 8/1994 |
| DE | 196 21 507 C1 | 9/1997 |
| EP | 0 425 021 B1 | 5/1991 |
| EP | 0 907 515 B1 | 4/1999 |
| JP | 59006763 A | 1/1984 |
| JP | 05140903 A | 6/1993 |
| JP | 2002320373 A | 10/2002 |

* cited by examiner

*Primary Examiner*—Patrick Mackey
*Assistant Examiner*—Jeremy R. Severson
(74) *Attorney, Agent, or Firm*—Laurnece A. Greenberg; Werner H. Stemer; Ralph E. Locher

(57) ABSTRACT

A transport system is configured for a machine that processes printing material. The transport system has a guide device with one or more diverters and one or more runners that travel along the guide device. An electric linear drive of the transport system has a primary part formed with winding cores and a secondary part formed by the runner. In the region of the diverter, at least one of the cores has a lower height than the cores outside the region of the diverter. This forms a cutout or depression for at least one guide segment of the guide device.

15 Claims, 11 Drawing Sheets

620
609
340
H
H'
606
60
38
33
62
h
602
N
30
600
35
18
34
S
610
14
608
37
604
H''
610

TRANSPORT SYSTEM IN A MACHINE THAT PROCESSES PRINTING MATERIAL

CROSS-REFERENCE TO RELATED APPLICATION

This application claims the benefit, under 35 U.S.C. § 119(e), of provisional patent application No. 60/523,328, filed Nov. 19, 2003; this application also claims the benefit, under 35 U.S.C. § 119, of German patent application 103 51 619.0, filed Nov. 5, 2003; the prior applications are herewith incorporated by reference in their entirety.

BACKGROUND OF THE INVENTION

Field of the Invention

The present invention relates to a transport system in a machine that processes printing material. The machine includes a guide device with at least one diverter, at least one runner that can be moved along the guide device, and an electric linear drive with a primary part comprising cores and a secondary part comprising the runner.

Furthermore, the present invention relates to a method for manufacturing a primary part of an electric linear drive, in which a number of cores of the primary part are provided with windings.

It has become known, in machines which process printing material, for example in printing presses, to transport the printing material to be processed, for example printing material sheets ("sheets" in the following text), by means of a transport system based on electric linear drives.

Furthermore, it has become known, in machines which process printing material, for example in web-fed printing presses, to thread a printing material web to be processed ("web" in the following text) into the machine before the actual printing process by way of a transport system based on electric linear drives.

Furthermore, it is known to branch off transport systems and/or to bring them together and to equip them with switchable diverters for this purpose. As the carriages or slides of the system that follow one another are often at only short distances from one another, it is necessary to provide diverters with short switching times and high switching dynamics.

Prior art diverters can be designed as mechanically active or mechanically passive diverters, that is to say they comprise movable mechanical components, for example, rail sections, to change the traveled path, or they do not comprise such components.

Commonly assigned German patent DE 196 21 507 C1 (cf. U.S. Pat. No. 5,809,892) discloses a web threading device for web material, having a mechanically active diverter. Here, the device has a guide rail in which a pulling device for threading the web can be moved. The forward drive is produced by an electric linear drive which has a stator comprising electromagnets configured as cores of magnetizable material with coils in each case wound around them. The cores can be connected to one another via pole laminations. Furthermore, the linear drive has, as runner, the pulling device to which two or more permanent magnets or else closed, electrically excitable coils are fastened.

The pulling device can be configured as an elongate link chain whose length is greater than the distance between two adjacent drive stations configured as coils.

Furthermore, the device has one or more switchable diverters which are each configured as a rotatable disk on which sections of the guide rail which are bent in each case in different directions are arranged. A web path for the threading of the web can be set as a function of the rotary position of the disk.

When the diverter is switched, only sections of the guide rails are moved. The drive stations remain stationary.

The diverter described can only be used in conjunction with the pulling device designed as a link chain, as no drive stations are provided in the region of the diverter and the pulling device therefore has to be gripped in drive terms by drive stations which are arranged upstream of or downstream of the diverter.

Commonly assigned European patent EP 0 907 515 B1 (cf. U.S. Pat. No. 6,240,843) discloses a transport system for sheets. There, it is proposed to provide a transport system based on electric linear drives in a sheet-fed offset printing press, which transport system transports the sheets from a first to a second printing unit by means of sheet holding means which are arranged on forward drive elements and are configured as gripper crossmembers.

Here, individual links of the forward drive elements which are configured as link chains and form the runners of the drive are composed of magnetic material, for example of permanent magnets. The drive stations which form the stator of the drive contain known electromagnetic coils which produce a moving electromagnetic field for driving the forward drive elements forward.

The transport system has a guide device with a mechanically passive diverter, which can be formed, for example, by two additional drive stations which are arranged at the beginning of a respective branching path of the transport system and are alternately supplied with current in accordance with the path to be taken (that is to say, electromagnetic fields are deliberately turned on and off in parts of the transport path to produce lateral guiding forces), as a result of which the forward drive elements are conveyed into one path or into the other path.

The proposed solution has the problem that although the provided design of the diverter as a mechanically passive diverter, that is to say without moving components, permits rapid switching of the diverter and an arrangement of the branching paths without undercuts, it can be undesirably restricted in relation to the guiding accuracy of the forward drive elements in the region of the diverter, compared with the rigid guidance in mechanically active diverters.

Furthermore, passenger transport systems based on electric linear drives are known, in which switchable diverters are provided for branching the transport paths.

A system of that type is described in each case in Japanese patent applications JP 59-6763 A and JP 5-140903 A. The switchable diverters described in those documents are designed in such a way that not only guide devices, for example rail sections, are moved, but also the stator of the drive together with said guide devices. A system of this type thus has the problem that elements having a great mass have to be moved in order to switch or actuate the diverter, with the result that rapid switching of the diverter with short switching times does not appear to be possible. However, slow switching appears acceptable in the field of passenger transport systems, as the individual trains of the system are at large distances from one another.

Furthermore, pivoting diverters or bending diverters based on an electric linear drive (for example, in the case of the Maglev train system Transrapid®) are known from the field of passenger transport systems. In those diverters both the rail sections and the stator are moved by bending. For this purpose, however, high actuating forces and long actuating paths are required, which leads to lower actuating dynamics.

Finally, it is also possible to exchange the entire section of the transport system, including rails and stator, in the region of the diverter. This does not permit high switching dynamics either, however, on account of the masses to be moved.

SUMMARY OF THE INVENTION

It is accordingly an object of the invention to provide a transport system in a print material-processing machine which overcomes the above-mentioned disadvantages of the heretofore-known devices and methods of this general type and which is improved relative to the prior art.

It is a further or alternative object of the present invention to provide an improved transport system in a machine which processes printing material.

It is a further or alternative object of the invention to provide a transport system with a diverter that switches rapidly or can be switched rapidly.

It is a yet a further or alternative object of the invention to provide a transport system with a diverter with very accurate guiding properties.

It is also an object of the invention to provide a transport system with mechanical components of a diverter that switch rapidly or can be switched rapidly.

It is yet a further or alternative object of the invention to provide a transport system that is inexpensive to manufacture.

With the foregoing and other objects in view there is provided, in accordance with the invention, a transport system in a printing material-processing machine, comprising:

a guide device formed with guide element and having at least one diverter;

at least one runner movably disposed along said guide device;

an electric linear drive having a primary part with a plurality of cores having a height and a secondary part formed by said at least one runner;

at least one of said cores, in a region of said diverter, having a reduced height relative to said cores outside the region of said diverter, said cores with said reduced height defining a cutout for at least one guide segment of said guide device.

In other words, the transport system according to the invention has:

a guide device which has at least one diverter;

at least one runner which can be moved along the guide device; and an electric linear drive which has a primary part, comprising cores, and a secondary part, comprising the runner; and the system is distinguished by the fact that, in the region of the diverter, at least one core has a lower height than the height of cores outside the region of the diverter in order to form a cutout for at least one guide segment of the guide device.

As is customary, the cores (or teeth) of the primary part are arranged in such a way that grooves are formed between the cores, in which grooves the windings which are placed around the cores are accommodated.

The transport system according to the invention has a specially configured primary part of the electric linear drive. According to the invention, at least one core in the region of the diverter has a lower height than cores outside the region of the diverter.

The cutout in the primary part provided by the lower height of the core advantageously permits at least one guide segment, for example a rail piece, to be accommodated.

A diverter can be formed in the transport system in this simple way, in that guide devices, for example rails, are guided through the cutout in the primary part at the branching. The rails are advantageously made from nonmetallic material, for example plastic, at least in the region of the cutout. It is advantageous here that all the elements of the electric linear drive can be arranged at a fixed location and do not have to be moved together with the guide devices to be moved when the diverter is actuated or switched, with the result that a very rapid switching process and high switching dynamics can be achieved. It is also advantageously possible to avoid the transport device bending.

A further advantage of the invention can be seen in the fact that the runners of the linear drive, that is to say the carriages or slides of the transport system, are constantly under the driving influence of the electric linear drive, even in the region of the diverter, and consequently reliable and precise guidance of the carriages is also made possible in the region of the diverter.

A transport system according to the invention therefore provides rigid and thus accurate mechanical guidance, but it also permits rapid path change as a result of segmented guide elements which can be switched highly dynamically and independently of one another. A further respective advantage of the invention is formed by the separation of the drive system (electric linear drive) from the mechanical switching elements (segmented guide elements or rail pieces), the implementation of switching times which are shorter than the time it takes a runner (carriage) to pass through the diverter, and the possibility of switching over the diverter even while a runner is present in the region of the diverter.

A transport system according to the invention can be used in sheet-fed printing presses, in particular in sheet-fed rotary presses, for transporting, conveying, inserting and removing sheets.

Furthermore, a transport system according to the invention can be used in web-fed printing presses, in particular in web-fed offset rotary presses, for transporting, conveying or threading one or more webs.

Furthermore, a transport system according to the invention can be used in folders for transporting signatures or folded products.

Furthermore, a transport system according to the invention can be used in post-treatment machines (post-press machines), in particular in gluing machines, binding machines, punches, stacking machines or packaging machines for transporting or conveying printed products.

Furthermore, a transport system according to the invention can be used in digital printing presses, in particular in copiers, for transporting or conveying printing material.

Moreover, a transport system according to the invention can also be used in the printing preparation stage (in pre-press machines), in particular in plate exposers, for transporting or conveying printing plates instead of printing material.

One embodiment of the transport system according to the invention is distinguished by the fact that, with regard to the height of cores outside the region of the diverter, the cores are provided with windings only in a lower section. All the cores or only cores in the region of the diverter can be configured in this way.

In a further refinement of the invention, a transport system is distinguished by the fact that, with regard to the height of cores outside the region of the diverter, the cores are provided with windings only in a lower section which is less than approximately 75% or 50% of the height, in particular less than approximately 40% or 30% or 25% of the height.

Furthermore, one preferred embodiment of the transport system according to the invention can be distinguished by the fact that the at least one guide segment is arranged at a fixed location in the cutout.

According to a further preferred embodiment, the transport system according to the invention is distinguished by the fact that the at least one guide segment is configured to be movable, in particular linearly movable or pivotable, at least partially into the cutout or laterally toward the cutout.

Furthermore, it is possible according to another preferred embodiment of the transport system according to the invention that the at least one guide segment can be moved between a passive position and an active position.

In a further preferred refinement of the transport system according to the invention, a further guide segment can be moved between the active position and a further passive position.

It is also an object of the present invention to provide an improved method for manufacturing a primary part of an electric linear drive. Similarly, it is a further or alternative object of the invention to provide a method for manufacturing a primary part of an electric linear drive, which method permits simple execution.

It is a further or alternative object of the invention to provide a method for manufacturing a primary part of an electric linear drive, which primary part is suitable for use in diverters that switch rapidly or can be switched rapidly.

With the above and other objects in view there is also provided, in accordance with the invention, a method for manufacturing a primary part of an electric linear drive, which comprises:

providing a plurality of primary part winding cores defining a full height and a reduced height;

forming the winding cores with windings substantially only in a lower section thereof; and manufacturing at least one of the winding cores with the reduced height relative to the full height of the winding cores.

In other words, the method according to the invention for manufacturing a primary part of an electric linear drive, in which a number of cores of the primary part are provided with windings, is distinguished by the fact that, with regard to their height, the number of cores are provided with windings only in a lower section, and by the fact that at least one core is manufactured with a lower height.

The method according to the invention advantageously permits particular primary parts of electric linear drives to be manufactured simply. Primary parts manufactured in such a way can advantageously be used in transport systems which are equipped with branches and with diverters arranged at the branches.

By at least one core being manufactured with a lower height, the primary parts manufactured according to the invention permit the hollowed-out space above the core of lower height to be used for guide devices, for example rails, with the result that the rails can be led through the primary part and the primary part can be used in the region of a diverter in this manner.

A further advantage of the manufacturing method according to the invention is to be found in the fact that primary parts for electric linear drives can be produced in a simple manner which permit a runner of the drive to be driven without interruptions and disturbances, even in the region of diverters.

In a further embodiment, a method according to the invention is distinguished by the fact that, with regard to their height, the number of cores are provided with windings only in a lower section which is less than approximately 75% or 50% of the height, in particular less than approximately 40% or 30% or 25% of the height.

Furthermore, a preferred embodiment of the method according to the invention can be distinguished by the fact that the lower height of the at least one core is made by removing material, in particular by milling or grinding, or by not removing material, in particular by punching.

Other features which are considered as characteristic for the invention are set forth in the appended claims.

Although the invention is illustrated and described herein as embodied in a transport system in a machine which processes printing material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
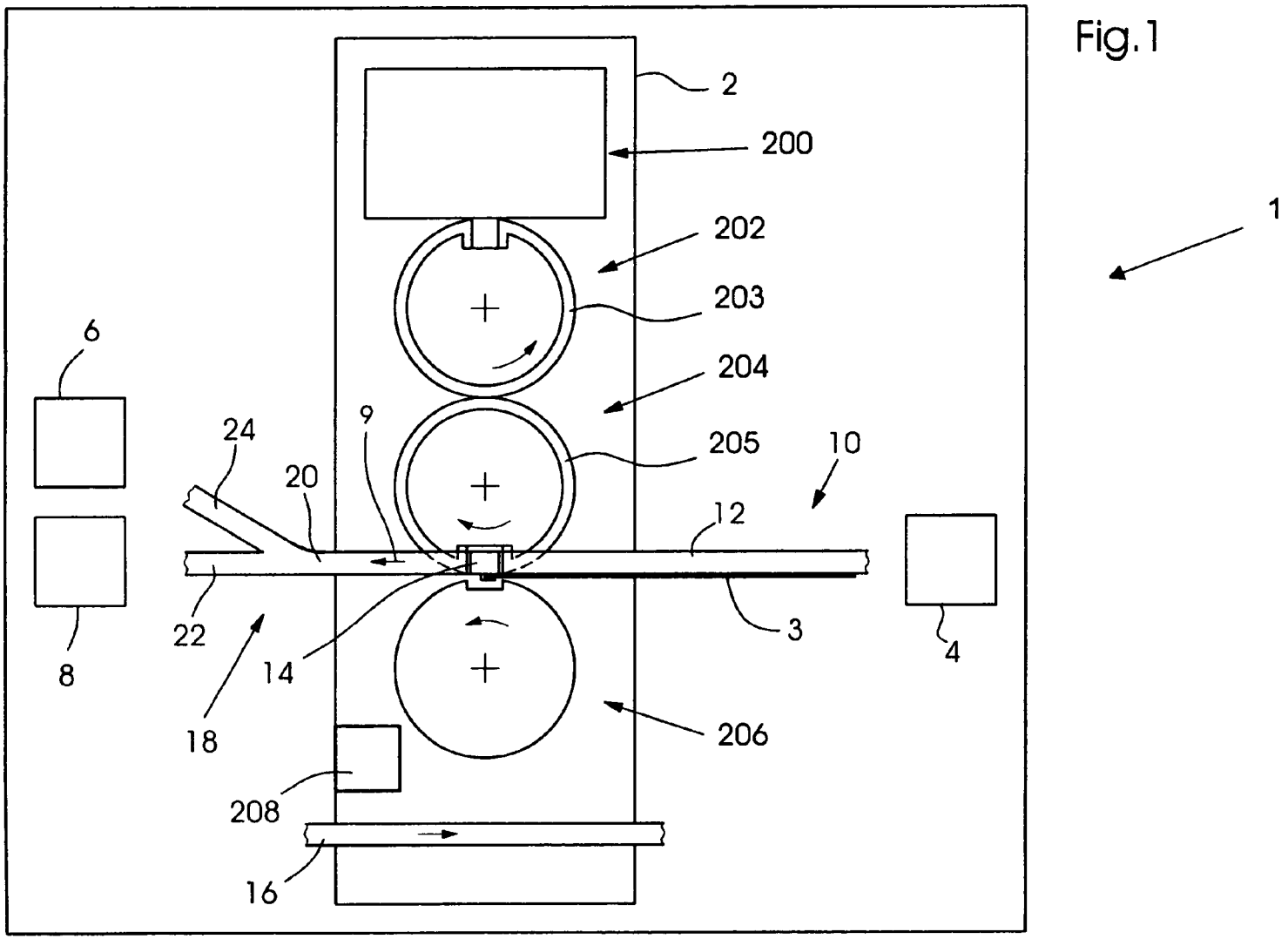
FIG. 1 is a diagrammatic side view of a printing unit having a transport system according to the invention.

Referring now to the figures of the drawing in detail and first, particularly, to FIG. 1 thereof, there is shown a diagrammatic side view of a printing unit 2 of a printing press 1 which processes printing material 3 (for example in the form of printing material sheets). At least one unit 4, for example a further printing unit or a sheet feeder, is arranged upstream of the printing unit 2, and at least two units 6, 8, for example further printing units, varnishing units, dryers, sheet deliverers or post-press devices (for example cutting machines, folders, punches, binding machines or packaging stations), are disposed downstream of the printing unit 2, in the product travel direction.

The printing unit has an inking and/or dampening unit 200 with rolls, a form cylinder 202 with a printing form 203 (for example a printing plate or printing sleeve) clamped on it, a transfer cylinder 204 with a transfer blanket 205 (for example a rubber blanket or a rubber blanket sleeve) clamped on it, and an impression cylinder 206. Furthermore, the printing unit 2 can have a separate motor 208 for driving the cylinders and rolls, or the printing unit can be driven by a common drive for a plurality of printing units.

The sheets 3 to be processed are transported from the unit 4 to the printing unit 2 and further in the direction of movement 9 to at least one of the two units 6, 8. For this purpose, the printing press 1 has a transport system 10 for the sheets 3. The transport system 10 extends along the transport path and has at least one guide device 12 and at least one carriage 14 which can be moved along the guide device and on which the sheets 3 are held. The carriages 14 are returned to the unit 4 on a return section 16 of the transport system 10.

In order to simplify the illustration, only one guide device 12 is shown in FIG. 1. However, the transport system can preferably have guide devices lying opposite one another on each side of the printing press which follow substantially the same traveled path in order to guide the carriage 14.

It can be gathered from FIG. 1 that the transport system has a diverter 18, at which a first path 20 of the guide device 12 branches into a second and third path 22, 24 of the guide device 12. The diverter is thus arranged at a branch of the transport path.

Figure 2:
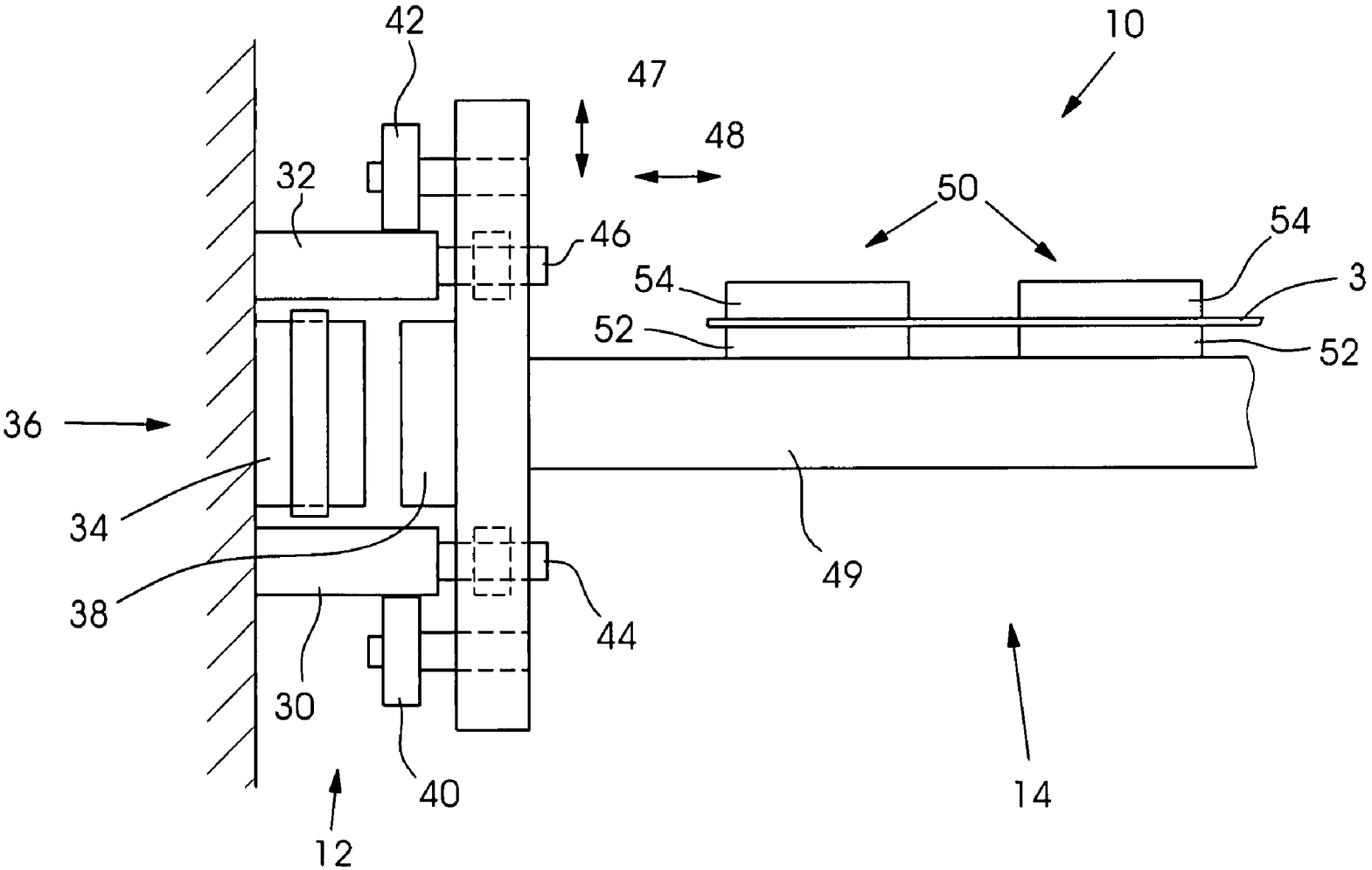
FIG. 2 is a diagrammatic sectional view of the transport system according to the invention.

FIG. 2 shows a side view of the transport system 10. Here, to simplify the illustration, only one lateral end section of a carriage 14 and one guide device 12 which guides said end section is shown, which guide device 12 can be arranged, for example, on one side wall of the printing press 1 or of the printing unit 2. However, the other, opposite lateral end section (not shown) of the carriage can likewise be guided in a guide device which is preferably disposed on the opposite wall of the printing press or of the printing unit.

The guide device 12 of the transport system 10 comprises two mutually spaced-apart rails 30, 32 (extending into the plane of the drawing in the figure), between which a primary part 34 of an electric linear motor 36 is arranged. The secondary part 38 of the electric linear motor 36 comprises the carriage 14 configured as a runner, a section 38 of the carriage 14, or an element 38 arranged on the carriage 14. As an alternative, the carriage 14, a section 38 of the carriage 14, or an element 38 arranged on the carriage 14 forms the secondary part 38 of the electric linear motor 36.

The carriage 14 is supported on the rails 30, 32 via wheels 40, 42, 44, 46 in such a way that the carriage is reliably guided both in the perpendicular direction 47 and in the lateral direction 48 with respect to the extent of the rails, that is to say it cannot essentially perform any movements, and can be moved in the direction of the extent of the rails (into the plane of the drawing in the figure). The magnetic forces of attraction between 38 and 34 act as counterbearings to the wheels 44, 46.

Furthermore, the carriage 14 has a crossmember 49 on which gripper units 50 are disposed. The gripper units 50 hold the sheet 3 to be transported or processed between gripper pads 52 and movable grippers 54.

Figure 3:
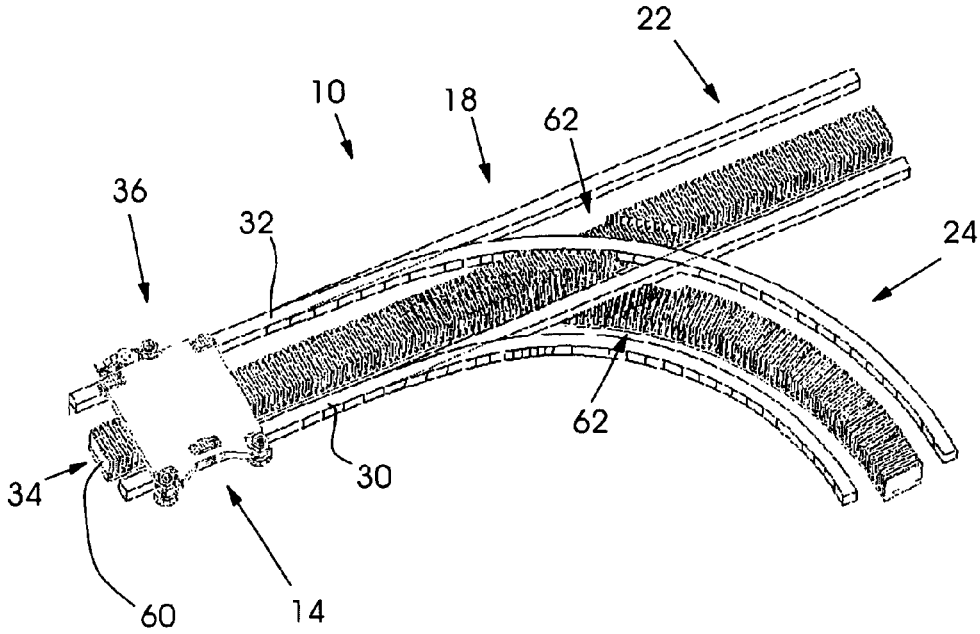
FIG. 3 is a top side perspective view of a transport system according to the invention.

The transport system 10 according to the invention in the region of the diverter is shown in FIG. 3.

The region of the diverter can be understood as being that region which extends along the guide device 12 substantially across the branch of the guide device 12. In this case, a respective section of the first, second or third path 20, 22, 24 which is arranged directly upstream or downstream of the branch can also be counted as part of the region of the diverter. In particular, the region of the diverter can be understood as that region of the transport system in which the transport system, the guide device or the primary part of the electric linear drive has elements of the diverter.

In the narrower sense, the region of the diverter can also be understood as being only that region in which, as is explained in greater detail in the following text, rails of the guide device are guided through cutouts (alternative designation: apertures) which are provided in the primary part.

It can be seen that the primary part 34 of the electric linear drive 36 extends between the rails 30, 32, and the movable carriage 14 (alternatively: capable of being moved, displaced or driven forward) is shown supported on the rails.

FIG. 3 simultaneously shows the two possible paths 22, 24 of the carriage 14 after it leaves the diverter 18. The exact location or position of the rails 30, 32 in the region of the diverter is shown clearly in the further figures.

Figure 9:
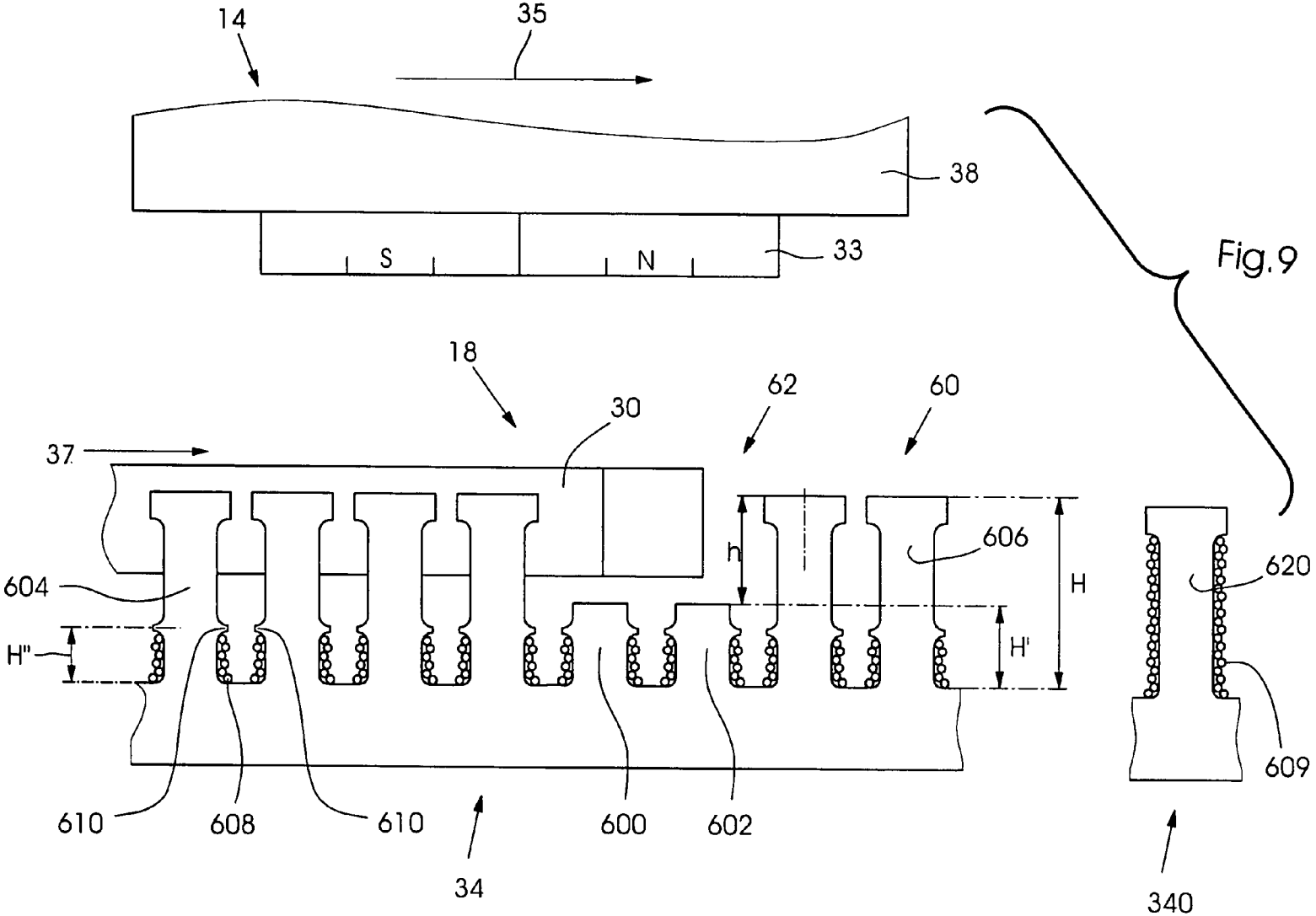
FIG. 9 is a sectional view through the primary part of the guide device in the region of the diverter.

As can be gathered from FIG. 3, the primary part 34 is composed of winding cores 60 (alternative designation: wound heads, pole elements, or stator teeth) which follow one another in the travel direction and are designed to bear windings (see also, FIG. 9). In the region of the diverter 18, at least some cores or teeth 60 (overall or partially) are of a lower height, in such a way that a cutout 62 is produced in the primary part 34, in which sections or segments of the rails 30, 32 are accommodated or can be accommodated, for example by being arranged, pivoted and/or moved linearly or by being exchanged (see also FIG. 4).

The cutouts make it possible for the rails 30, 32 to pass through the primary part 34 in the region of the diverter 18 in an unimpeded manner.

Figure 4:
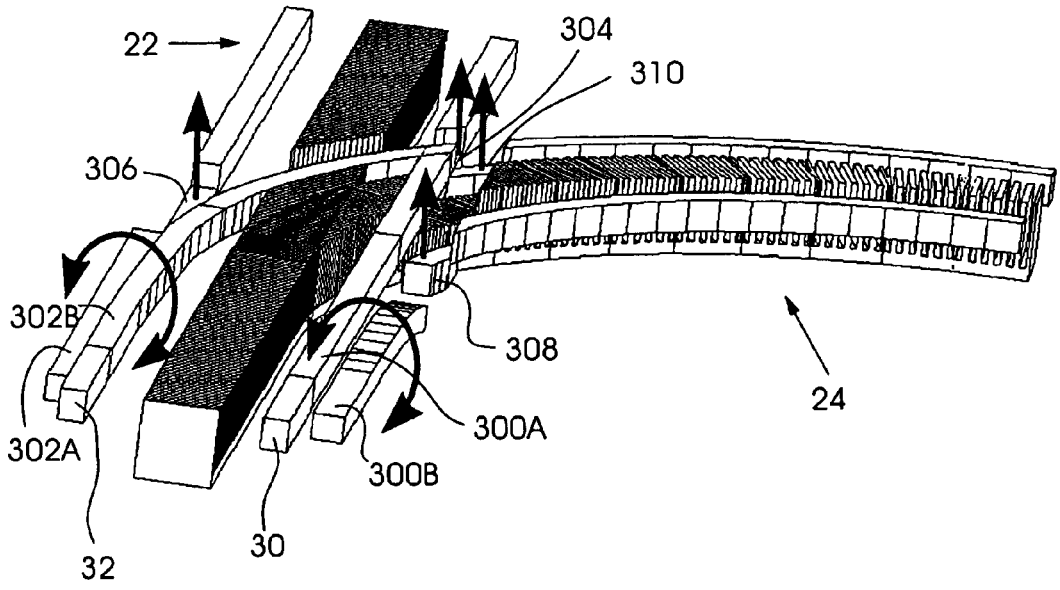
FIG. 4 is a top side perspective view of a transport system according to the invention.

Arrows in FIG. 4 show how the actuation of the diverter 18 can be achieved by pivoting and/or linear movement of segments, or by exchanging segments of the rails 30, 32.

By pivoting segments 300A, 300B and 302A, 302B together and, as a consequence, exchanging them, it is possible to move or change between the outbound path 22 (direction straight ahead) and the outbound path 24 (branched direction). The segments 300A, 300B show the position for guidance straight ahead in FIG. 4, while the segments 302A, 302B show the position for guidance into a curve in FIG. 4 (this illustration is intended to show only the various actuating possibilities, both pairs of segments are adjusted uniformly in practice, that is to say either in the direction straight ahead or in the direction into a curve).

The respective segments 304, 306 of the two rails 30, 32 can be displaced between two positions by being moved up and down linearly, cutouts for the wheels of the carriage being opened in the lower or lowered position, with the result that the carriage can follow a curve to path 24, while the rails are closed in the direction straight ahead, substantially without gaps, in an upper or raised position, with the result that the carriage can be guided straight ahead to path 22.

Furthermore, the segments 308, 310 can also be pivoted and/or moved linearly from a respective lower position into a respective upper position. In the process, the segments 308, 310 release the direction straight ahead in their lower position, while they close gaps in the rails 30, 32 in the branching-off direction in their upper or raised position.

Further segments of the rails 30, 32 shown in FIG. 4 are arranged at a fixed location, in particular in the region of the diverter.

The segments described are formed by segmentation of the guide device in the direction of movement.

Figure 5:
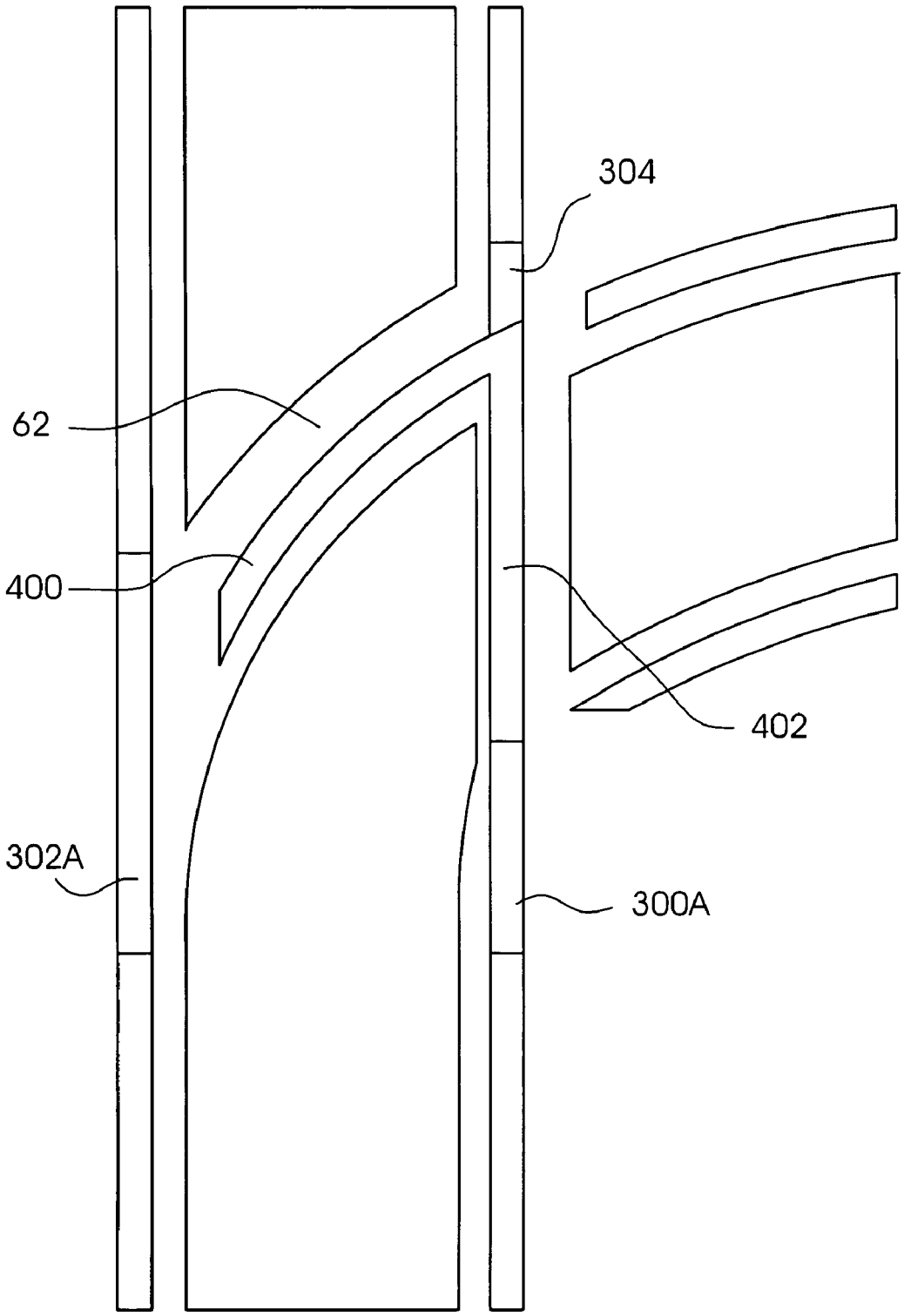
FIG. 5 is a diagrammatic plan view of the region of the diverter of a transport system according to the invention, in a first diverter position.
Figure 6:
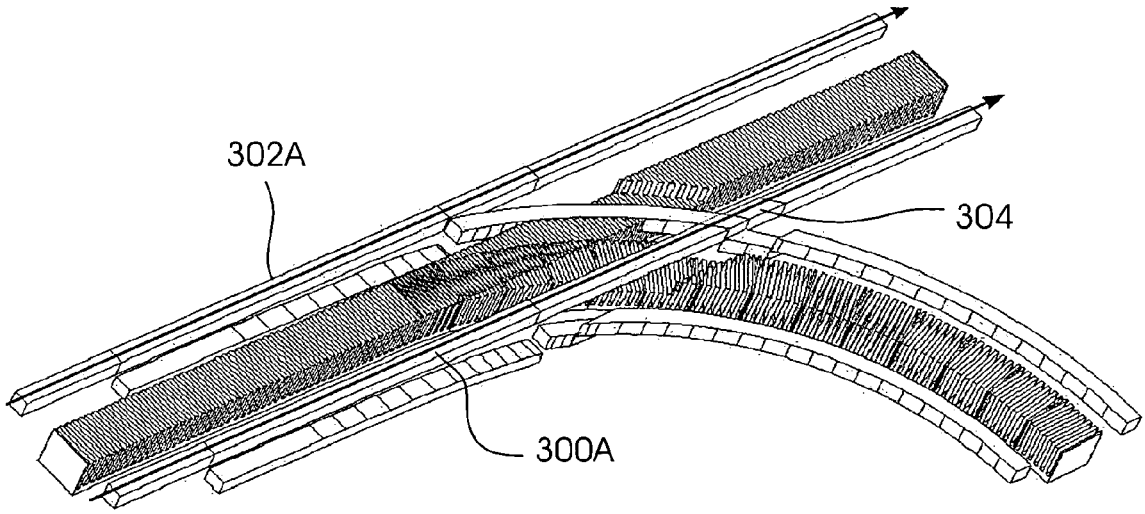
FIG. 6 is a top side perspective view of the region of the diverter of a transport system according to the invention, in the first diverter position.

The illustrations in FIGS. 5 and 6 show which segments are arranged in which position to set the diverter to the direction straight ahead (first position of the diverter).

Figure 7:
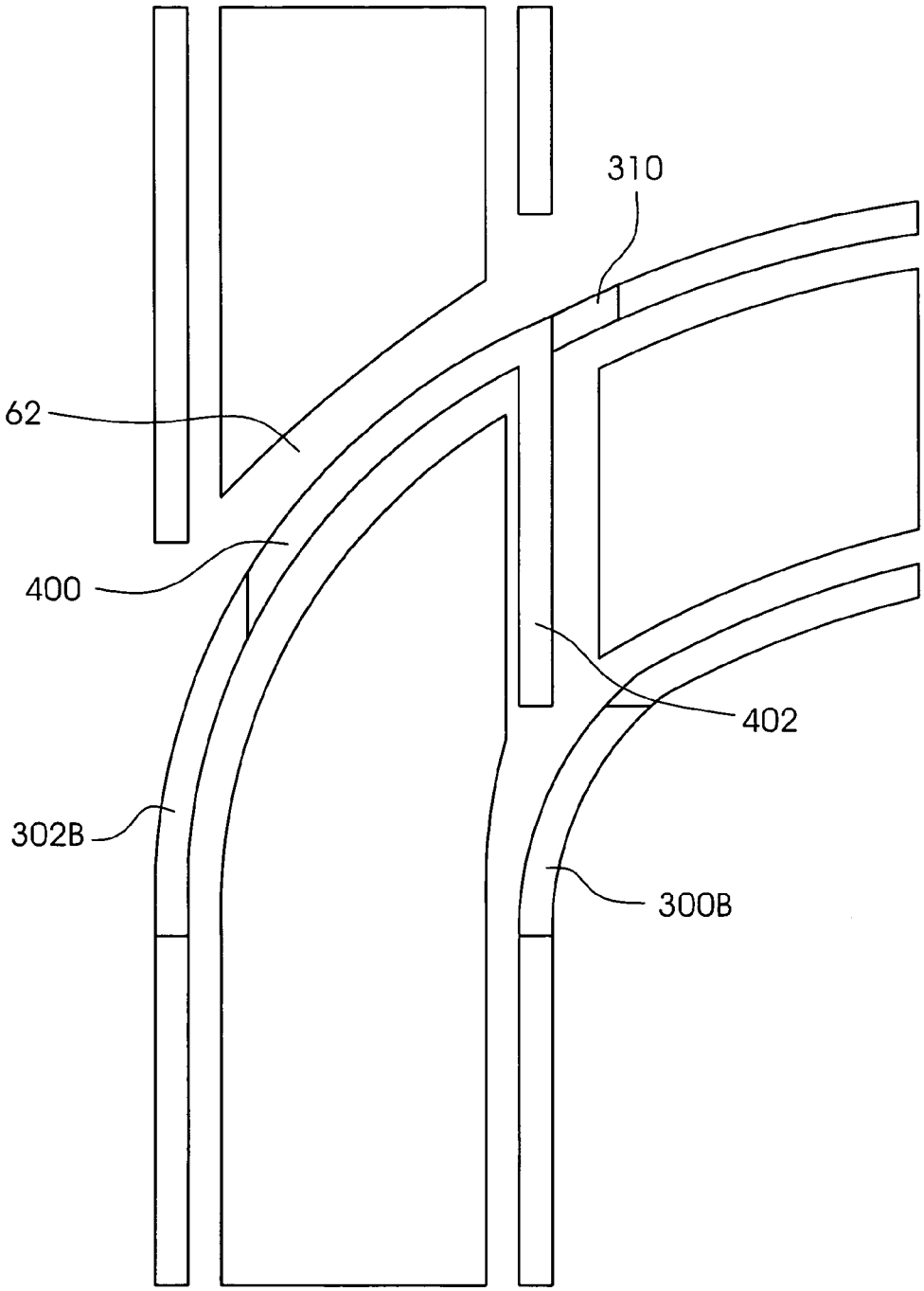
FIG. 7 is a diagrammatic plan view of the region of the diverter of a transport system according to the invention, in a second diverter position.
Figure 8:
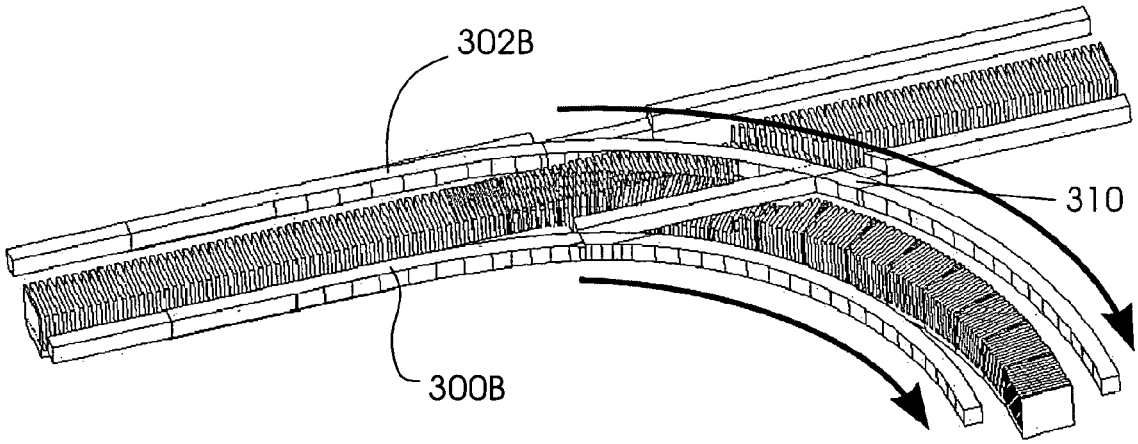
FIG. 8 is a top side perspective plan view of the region of the diverter of a transport system according to the invention, in the second diverter position.

The illustrations in FIGS. 7 and 8 show which segments are arranged in which position to set the diverter to the branching-off direction (second position of the diverter).

In the first position of the diverter, the segments 300A and 302A are in their respective active position, likewise segment 304. In contrast, the segments 300B, 302B and 310 are in their respective active position in the second position of the diverter. Active position is to be understood here as meaning that the relevant segments are parts of the course of the rails. In a corresponding passive position (or: parked position), the relevant segments are not part of the course of the rails.

In FIGS. 5 and 7, furthermore, guide segments 400, 402 are shown which are arranged at a fixed location in a cutout 62 of the primary part.

The sectional view shown in FIG. 9 through the primary part 34 shows the cores 60 made from magnetizable material, two cores 600, 602 in the region of the diverter 18 having a lower (i.e., decreased or reduced) height H' compared with the "full height" H of the cores 604, 606 outside the region of the diverter 18. The result is a cutout 62 of height h through which the rails 30 (or else 32) can extend unimpeded.

The cores 60 of the primary part 34 (both those of height H and those of height H') are surrounded by windings 608 (or: coils) only to a preferably uniform height H", the height H" being less than or equal to H'. The windings 608 can be fixed by lugs 610 arranged on the cores 60. The lugs 610 are preferably arranged at the same height (substantially H") on all the cores 60. Furthermore, the lugs 610 can be formed by projections on the cores 60.

Furthermore, FIG. 9 also shows the secondary part 38, i.e. the runner of the drive, which is configured as a carriage or slide 14 and is arranged movably, spaced apart from the primary part 34 by an air gap 37. In the example shown, at least one permanent magnet 33 (alternatively: a squirrel cage of an asynchronous machine) is arranged on the carriage 14 for coupling purposes. Instead of the permanent magnet 33, it is also possible to provide a magnetizable core and an electrically excitable coil. The windings 608, in particular three-phase windings, of the primary part 34, i.e. of the stator, produce a moving magnetic field when current is applied correspondingly, i.e. a field which moves along the primary part 34 to which the magnetic field of the permanent magnet 33 is coupled and by which the permanent magnet 33 and thus also the carriage 14 are carried and driven forward in a known manner in the direction of movement 35.

Although it cannot be seen in FIG. 9, the primary part 34 (and in particular the cores 60) can comprise many layers of mutually insulated magnetic steel plates and form a laminated stator core. The forward drive movement of the carriage 14 can be desirably influenced in the usual manner by non-illustrated open-loop, closed-loop, or mixed control devices which control or regulate the supply of current to the windings 608, that is to say the carriage 14 can be, for example, accelerated or braked, or moved with a constant velocity, maintaining a distance to further carriages or in register.

Primary parts 340 outside the region of the diverter, in particular in the paths 20, 22 and 24, can have windings 609 in the conventional manner which use substantially the full height of the cores 620 and thus have an optimum space factor and produce a great magnetic flux density in the gap. In this way, it is advantageously possible to achieve the situation in which high cores with a low space factor are used only in the region of the diverter.

The primary part 34 shown in. FIG. 9 can be part of a diverter component, so that the phrase "within the region of the diverter" used in this application can also be understood in such a way that "in the region of the diverter component" is therefore meant, while the primary part 340 can be part of a (diverterless) path component, so that the phrase "outside the region of the diverter" used in this application can also be understood in such a way that "in the region of the path component" is therefore meant.

Figure 10:
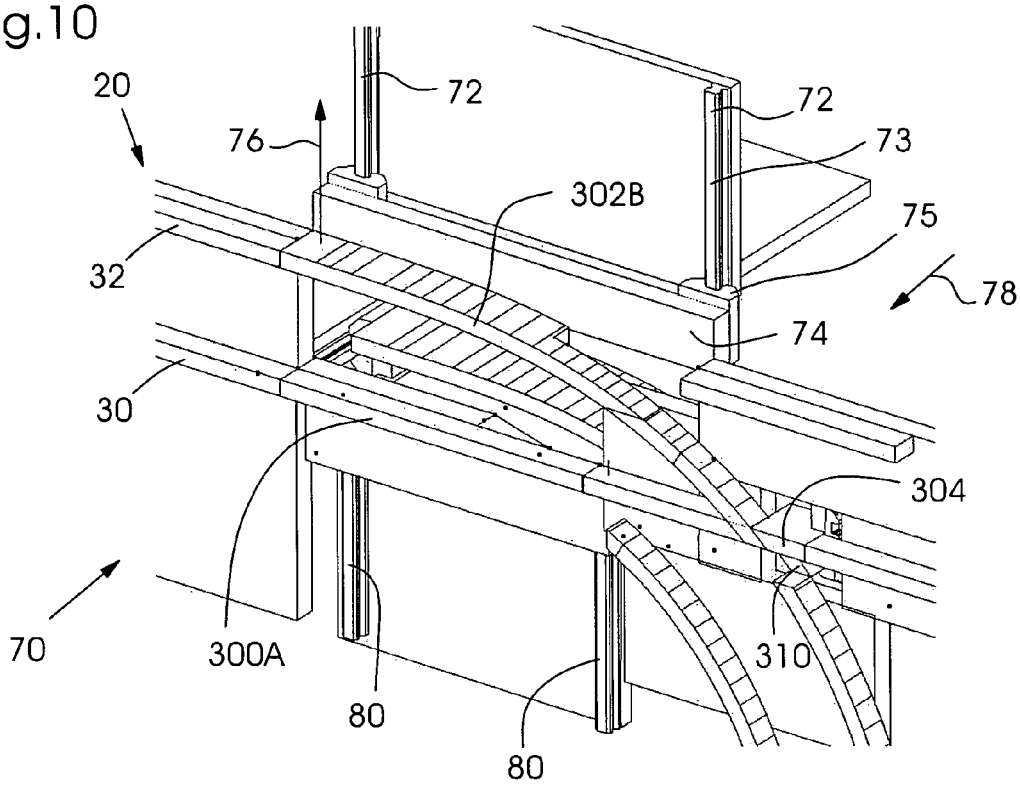
FIG. 10 is a first perspective view of a transport system according to the invention having a diverter adjusting unit.

The diverter adjusting unit 70 shown in FIG. 10 (front view) comprises a linear guide 72 (with rail 73) for an installation element 74 (alternative designation: basic plate) on which the segment 302B of the rail 32 is arranged. When the diverter 18 is actuated or switched, the segment 302B can be moved out of its active position linearly along the linear guide (upward in the figure) into its passive position. This movement is shown by the arrow 76. Here, the linear displacement movement takes place substantially perpendicularly to the direction of the incoming path 20 and in the plane defined by the two rails 30, 32.

Afterward or else substantially simultaneously, the segment 302A can be moved out of its passive position (behind the installation plate 74 in FIG. 10 and not visible) linearly along a linear guide (forward in the figure, cf. direction of movement 78) into the active position. This displacement position takes place substantially perpendicularly to the direction of the incoming path 20 and perpendicularly to the plane defined by the two rails 30, 32.

The segments 300A, 300B (cf. also FIG. 11) can likewise be displaced by means of linear guides 80, 82.

The segments 304, 310 can also be moved alternately out of passive positions into active positions and back again by means of linear guides.

Figure 11:
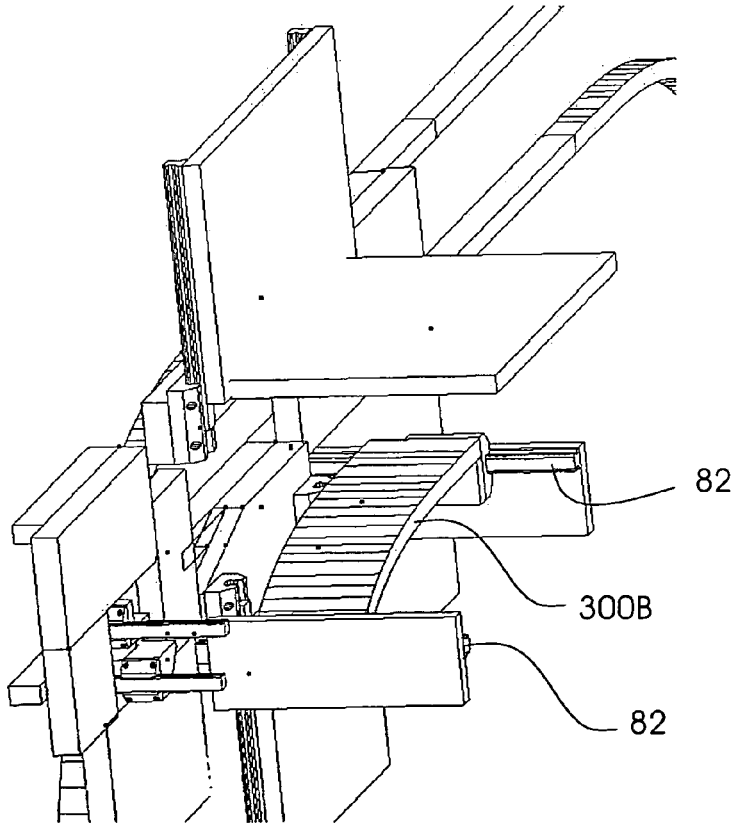
FIG. 11 is a second perspective view of a transport system according to the invention having a diverter adjusting unit.

In FIG. 11, the diverter adjusting unit is shown from behind (rear view), it being possible to see segment 300B in its passive position.

Furthermore, it is possible to also provide obliquely oriented adjusting apparatuses instead of the horizontal and vertical adjusting apparatuses for the segments.

Figure 12:
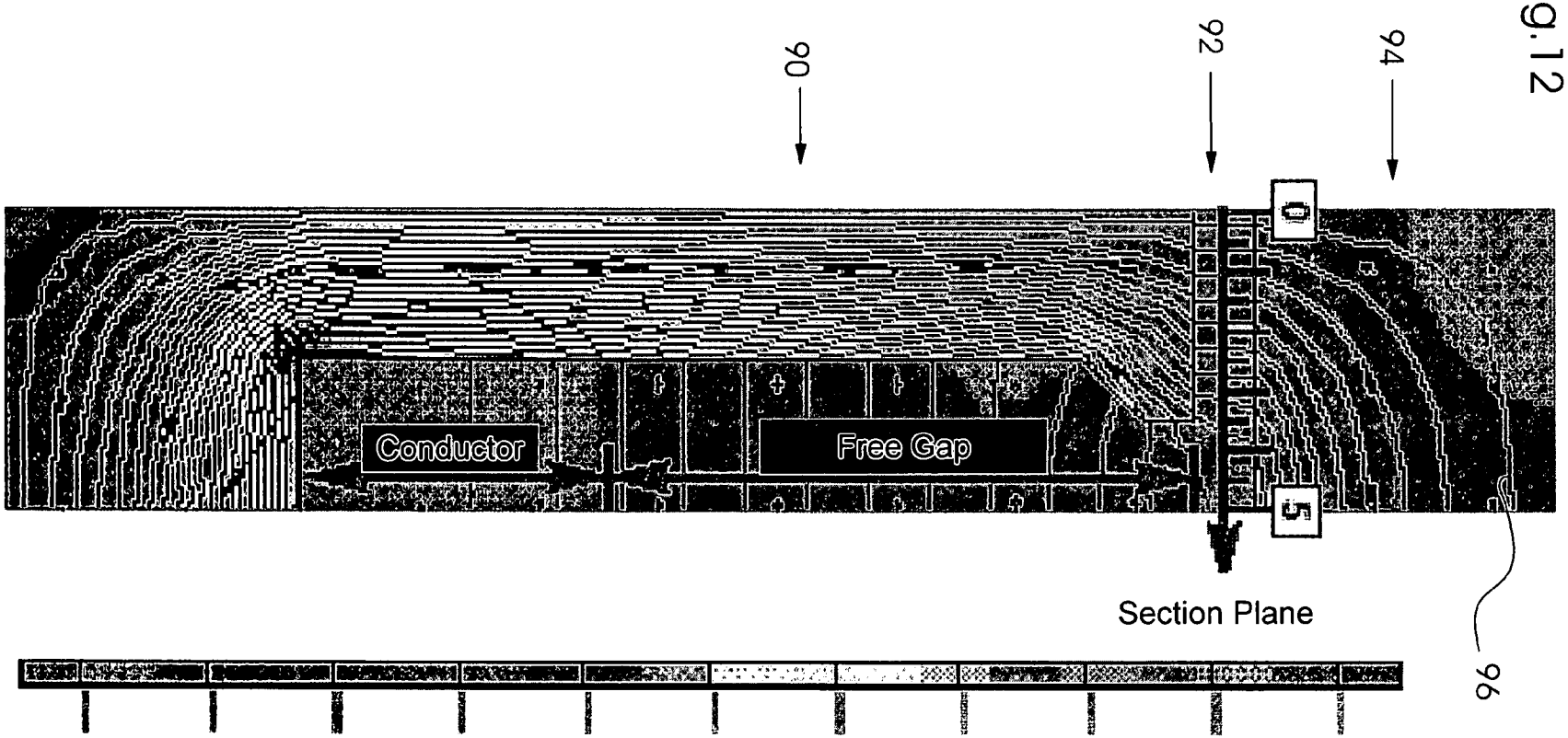
FIG. 12 is a graph showing a simulation calculation.
Figure 13:
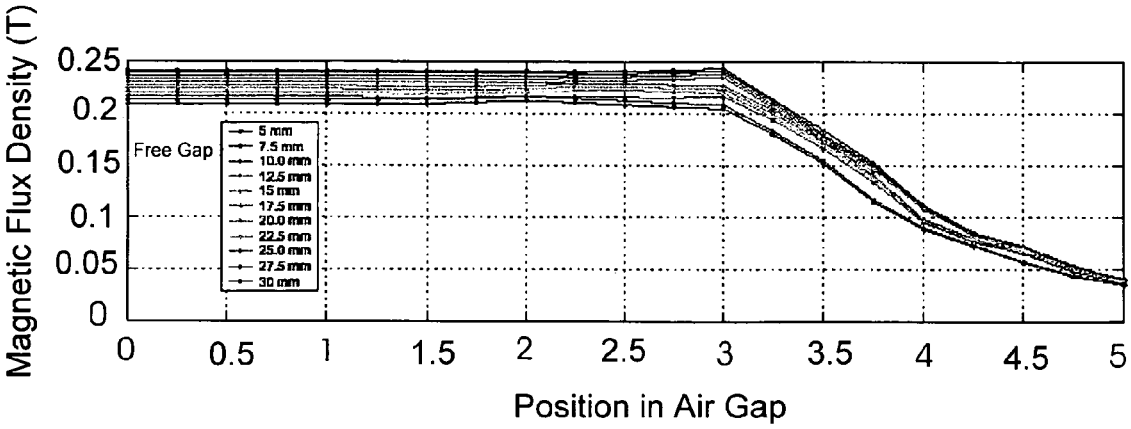
FIG. 13 is a graph diagram showing results of the simulation calculation.
Figure 14:
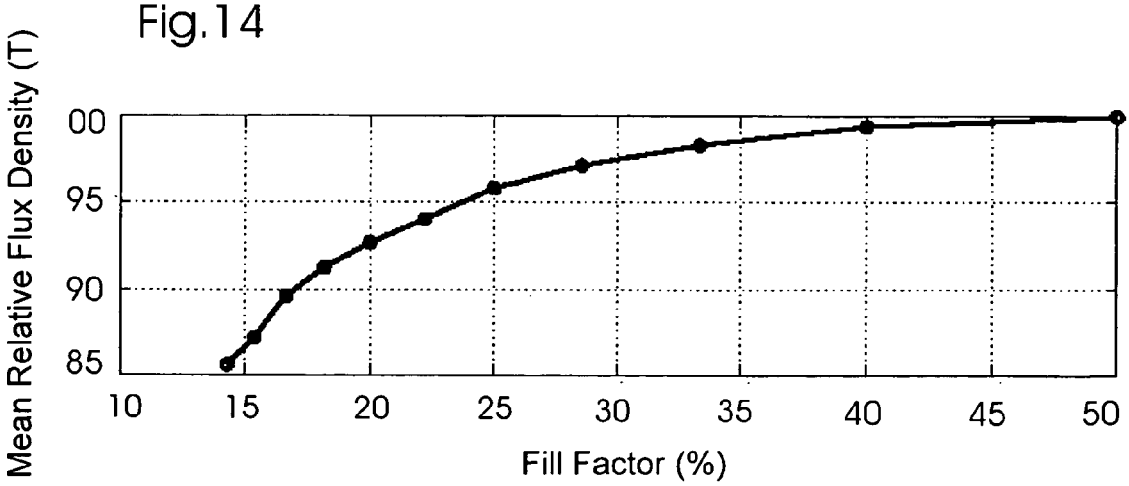
FIG. 14 is a graph diagram showing results of the simulation calculation.

FIGS. 12, 13 and 14 show a simulation calculation of the magnetic flux density B for a core which, with regard to its height, is only partially surrounded by windings.

FIG. 12 shows a detail of a simulated core 90 and a permanent magnet 94 which is situated above it and is spaced apart from the core 90 by a free gap, or air gap 92, and also the field lines 96 of the magnetic flux density B in this detail. The gray values used in the figure indicate the magnitude of the magnetic flux density B. The numbers 0 and 5 indicate the position in the air gap, as it is plotted on the abscissa in the diagram in FIG. 13.

FIG. 13 shows a diagram in which the magnetic flux density B (in Tesla) is plotted against the position in the air gap 92 (cf. numbers 0 and 5 in FIG. 12) for various free heights of the core 90. Free heights of the core are to be understood here as that section of the core which does not have a coil wound around it. It can be seen clearly that the variable (cf. various plotted curves), only partial surrounding of the core with windings has only a small influence on the magnetic flux density B. Furthermore, the magnetic flux density is substantially constant over approximately ⅗ of the gap region (0 to 3).

FIG. 14 shows a diagram in which the mean relative flux density (in Tesla) is plotted over the fill factor or space factor (in %). Here, the "fill factor" is to be understood as the proportion in percent of the height of the core surrounded by windings compared with the overall height of the core. It can be seen clearly here that the mean relative flux density converges toward 100% as the fill factor increases, is above 90% from a space factor value of approximately 25%, and already achieves approximately 100% of the maximum flux as early as when the space factor value is approximately 50%.

We claim:

1. A transport system in a printing material-processing machine, comprising:

a guide device formed with a guide element and having at least one diverter;

at least one runner movably disposed along said guide device;

an electric linear drive having a primary part with a plurality of cores having a height and a secondary part formed by said at least one runner;

at least one of said cores, in a region of said diverter, having a reduced height relative to said cores outside the region of said diverter, said cores with said reduced height defining a cutout for at least one guide segment of said guide device.

2. The transport system according to claim 1, wherein said cores include windings in a lower part thereof, with regard to the height of said cores outside the region of said diverter.

3. The transport system according to claim 2, wherein the lower part of said cores provided with said windings is less than approximately 75% of the height of said cores outside the region of said diverter.

4. The transport system according to claim 2, wherein the lower part of said cores provided with said windings is less than approximately 50% of the height of said cores outside the region of said diverter.

5. The transport system according to claim 2, wherein the lower part of said cores provided with said windings is less than approximately 40% of the height of said cores outside the region of said diverter.

6. The transport system according to claim 2, wherein the lower part of said cores provided with said windings is less than approximately 30% of the height of said cores outside the region of said diverter.

7. The transport system according to claim 2, wherein the lower part of said cores provided with said windings is less than approximately 25% of the height of said cores outside the region of said diverter.

8. The transport system according to claim 1, wherein said at least one guide segment is stationarily disposed in said cutout.

9. The transport system according to claim 1, wherein said at least one guide segment is movably disposed to be at least partially moved into said cutout or toward said cutout.

10. The transport system according to claim 9, wherein said at least one guide segment is linearly movable.

11. The transport system according to claim 9, wherein said at least one guide segment is pivotally mounted.

12. The transport system according to claim 9, wherein said at least one guide element is movably disposed between a passive position and an active position.

13. The transport system according to claim 12, which comprises a further guide segment movably disposed between the active position and a further passive position.

14. In combination with a material processing machine, the transport system according to claim 1 configured to transport the material of the machine.

15. In combination with a printing material-processing printing press, the transport system according to claim 1 configured to transport the printing material of the printing press.

* * * * *